United States Patent [19]

Nielsen et al.

[11] Patent Number: 5,046,407

[45] Date of Patent: Sep. 10, 1991

[54] ROOF WINDOW

[75] Inventors: Elgard S. Nielsen, Soborg; Arne B. Jensen, Charlottenlund, both of Denmark

[73] Assignee: V. Kann Rasmussen Industri A/S, Soborg, Denmark

[21] Appl. No.: 433,123

[22] Filed: Nov. 8, 1989

[30] Foreign Application Priority Data

Nov. 11, 1988 [DK] Denmark ..... 6297/88

[51] Int. Cl.[5] ..... E06B 7/02

[52] U.S. Cl. ..... 98/94.1

[58] Field of Search ..... 98/42.14, 94.1, 95, 98/98, 88.1, 116

[56] References Cited

U.S. PATENT DOCUMENTS 3,839,949 10/1974 Gobel ..... 98/42.14

FOREIGN PATENT DOCUMENTS 2248478 4/1974 Fed. Rep. of Germany ..... 98/88.1
3144351 5/1983 Fed. Rep. of Germany ..... 98/88.1
3807661 9/1988 Fed. Rep. of Germany ..... 98/116
112939 5/1987 Japan ..... 98/116

*Primary Examiner*—Harold Joyce
*Attorney, Agent, or Firm*—Lane, Aitken & McCann

[57] ABSTRACT

The upper horizontal main frame member (1) of a roof window is designed as a hollow box-like structure comprising an inner ventilating compartment (12) which through a flow passage (18) provided with an adjustable damper (19) communicates with an outer ventilating compartment (13) with air exhausts (20, 21) positioned at both end walls (22, 23) of the box-like structure in the outer side of the roof.

An aeration is thereby obtained which is also effective when the window is provided with a rolling louver assembly (15).

An exhaust fan (26) may be accommodated in the inner ventilating compartment (12) and the structure may be provided with separate remote-controlled motors for the exhaust fan (26), the rolling louver assembly (15) and the damper (19).

In a large room installation with a number of windows more windows may, for instance by grouping, be operated from a single control unit.

10 Claims, 4 Drawing Sheets

ROOF WINDOW

Figure 1:
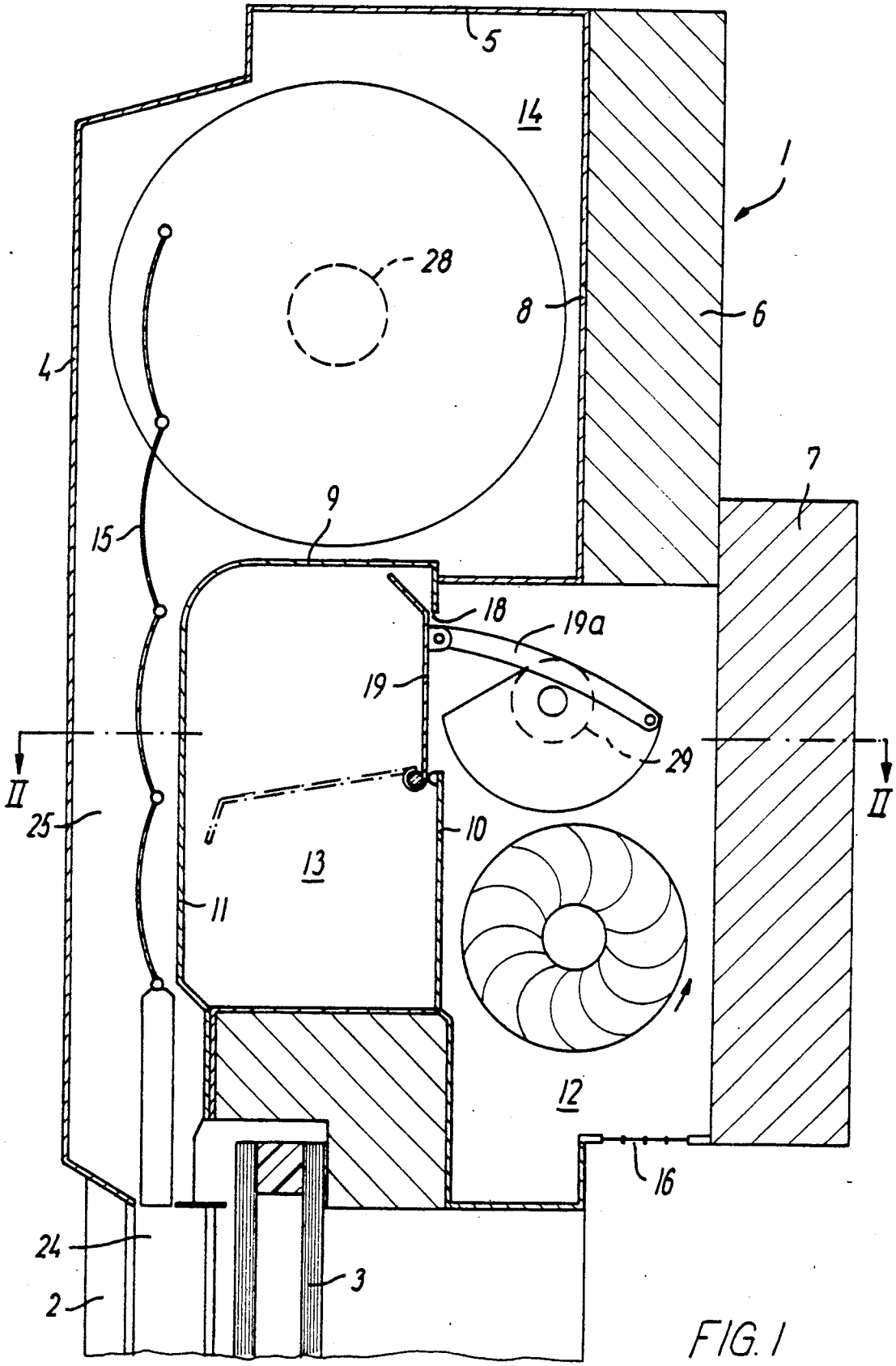

The invention relates to a roof window for installation in an inclined roof, comprising a rectangular main frame structure, of which at least an upper horizontal frame member is at least partially designed as a hollow box-like structure and includes a closeable passage for ventilating air from the external side of the box-like structure to the internal side thereof.

In known windows of this type the ventilating air passage extends through the upper horizontal main frame member from a slit that is closeable, for instance by means of an internal flap on the internal side of the main frame member to a likewise generally slit-shaped and horizontally extending air exhaust in a downwards facing side of the external part of the main frame member, immediately above the outer side of the pane portion of the window.

The aeration conditions of such a design have turned out to be greatly dependent on wind directions in relation to the inclined roof surface and in practice it has by natural ventilation frequently turned out to be impossible to obtain any noticeable air exhaustion, even at moderate wind velocities, e.g. 4 m/sec. and more, in case of wind directions transverse or obliquely towards the roof surface.

The object of the invention is to provide a design of the main frame structure that is considerably improved with respect to ventilation, and to accomplish this a roof window of the above type is according to the invention characterized in that said box-like structure includes an inner ventilating compartment which communicates through a slit with the internal side of the structure and through a flow passage provided with an adjustable damper with an outer ventilating compartment having air exhausts positioned at both end walls of the box-like structure, said end walls forming in the mounted state part of the external surfaces of the main frame structure extending in vertical planes on the external side of the roof.

The suggested design provides for obtaining ventilation properties that to a far higher degree are insensitive to wind conditions. In case of wind directions perpendicular to or obliquely hitting the roof, thereby forcing air upwards along the roof surface, there is obtained a satisfactory exhaustion through the air exhausts at either end of the box-like structure, even at comparatively high wind velocities. In case of wind directions lengthwise of the roof an air flow through the outer ventilating compartment will arise, thereby causing with open damper an ejector effect offering a satisfactory exhaustion.

Due to said improved ventilation properties the roof window according to the invention is particularly suitable for fixedly installed, i.e. non-openable windows, and thus particularly also for window installations in large rooms with a considerable number of high-level windows.

In order to provide under all circumstances the optimum possible ventilation conditions, a preferred embodiment of the roof window according to the invention particularly fitted for such applications is further characterized in that an exhaust fan is arranged in the internal ventilating compartment.

The invention entails the particular advantage that also in window designs with an exterior rolling louver assembly that is rolled up in a cavity in the upper horizontal main frame member an effective ventilation may be obtained, even when the rolling louver assembly is lowered.

In an embodiment of the roof window according to the invention parricularly suited for this application, the box-like structure includes a separate chamber for receiving a rolling louver assembly having an independent drive motor and being movable in slotted guideways at the outer side of the side members of the main frame structure and through a louver passage on the outer side of the outer ventilating compartment.

The invention further relates to a window installation for large rooms with inclined walls and with a number of roof windows of the above mentioned type, the box-like structure accommodating besides the above mentioned rolling louver assembly having an independent motor separate and remote-controlled motors for the damper and the exhaust fan.

According to the invention such a window installation is characterized in that the damper, exhaust fan and rolling louver motors for a number of windows may be selectively operated from a common control unit.

Figure 2:
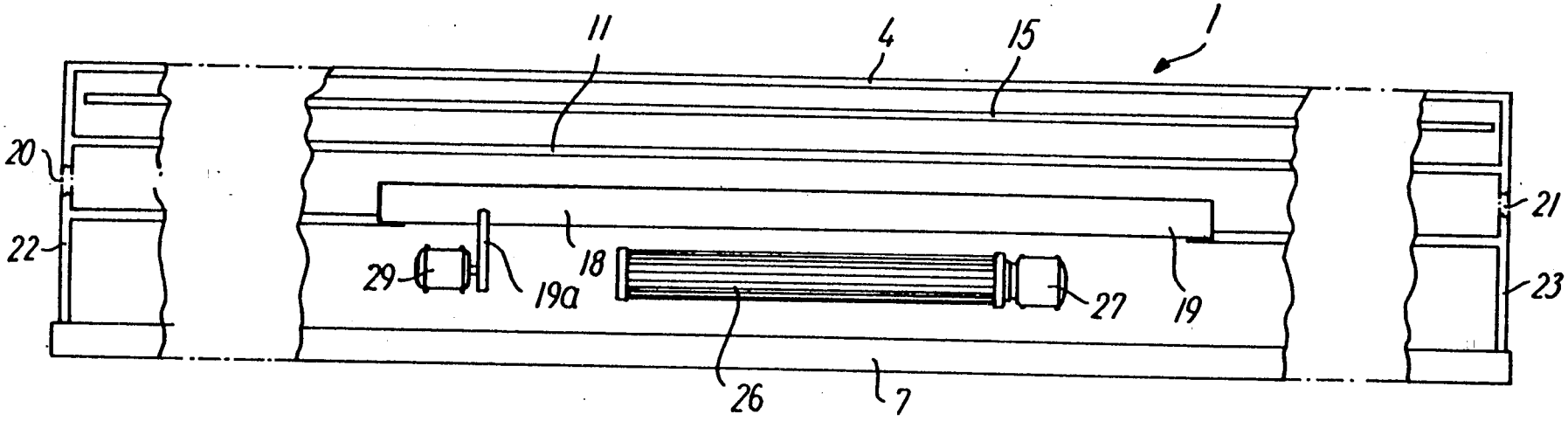
Figure 3:
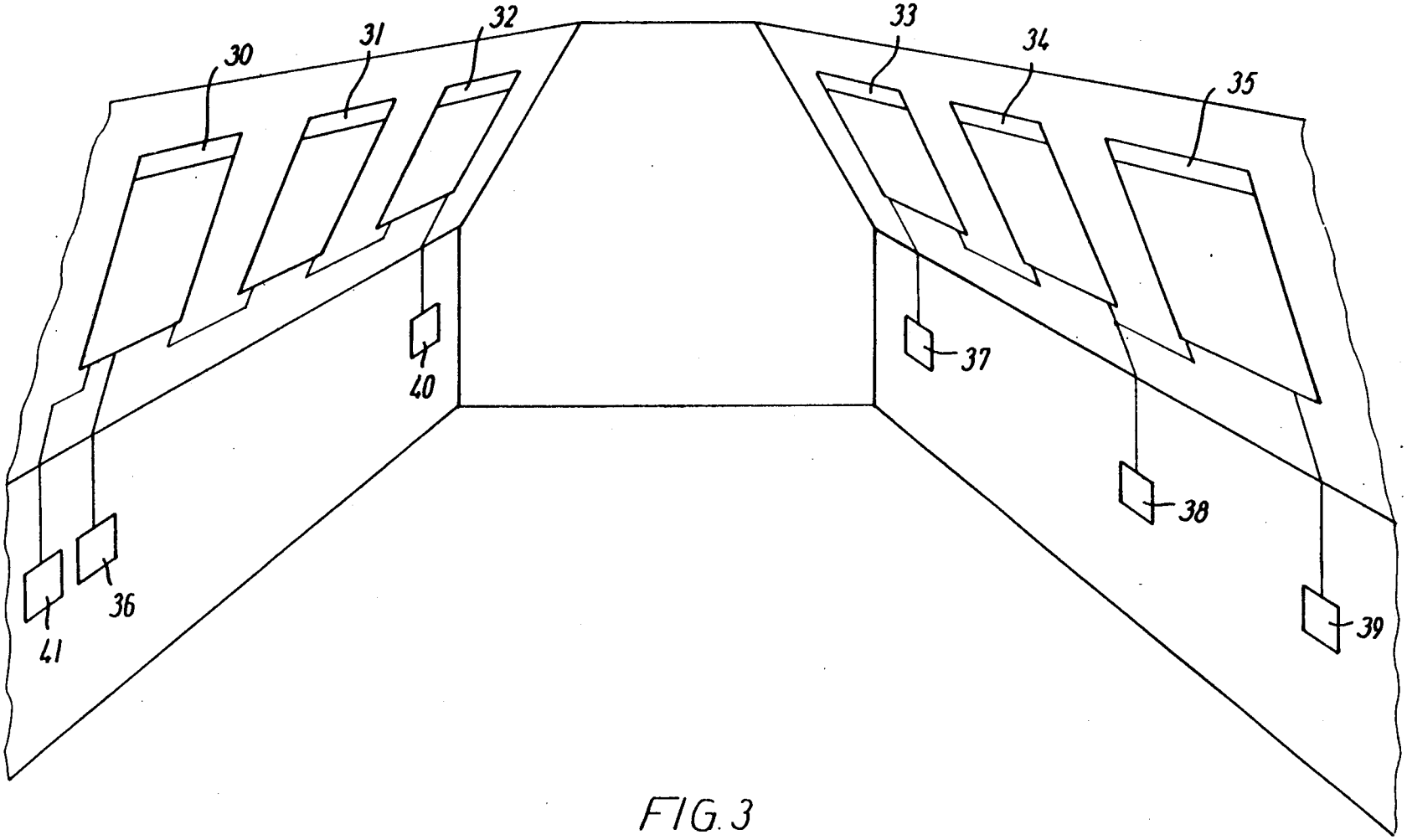
Figure 4:
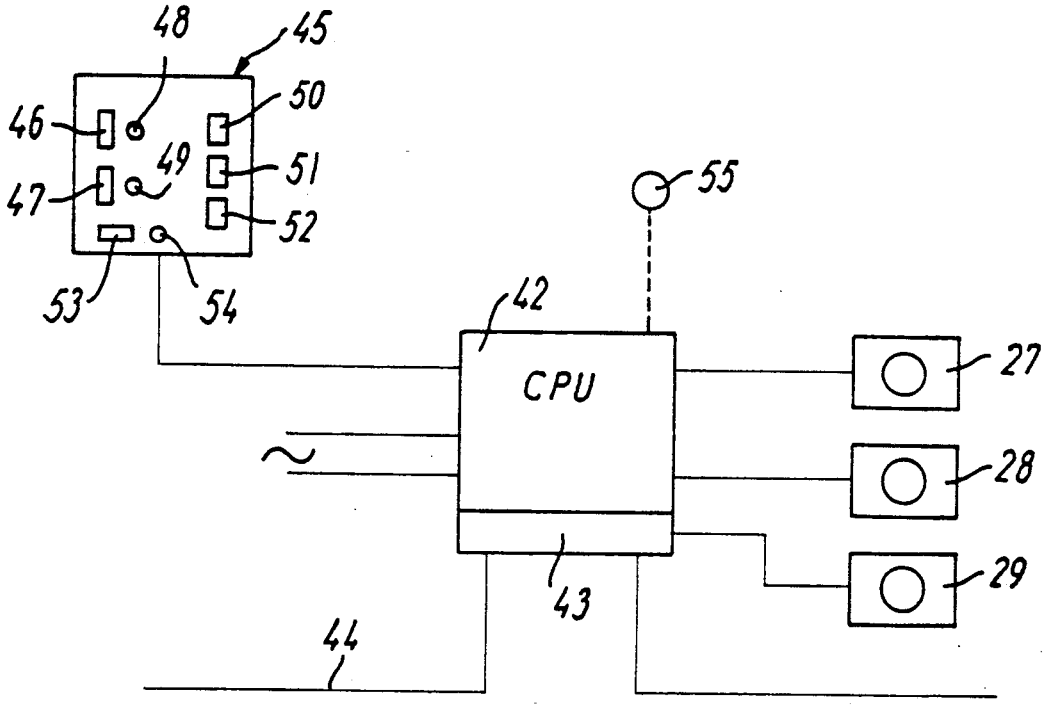

Further details and advantages of the invention will appear from the following description of design examples with reference to the drawings, in which FIG. 1 is a cross-sectional view of the upper horizontal main frame member in an embodiment of a roof window according to the invention, FIG. 2 is a longitudinal sectional view along the line II—II in FIG. 1, FIG. 3 is an example of a large room window installation, and FIG. 4 is a diagram of a control unit for use in connection with remote control of the windows in such an installation.

Besides the upper horizontal main frame member 1 of a roof window, the cross-sectional view in FIG. 1 illustrates only the top portion of the main frame side member 2 and the double-glazed thermo pane portion 3.

In the illustrated embodiment main frame member 1 includes a hollow box-like structure delimited by an external sidewall 4, a profiled upper wall 5, internal side members 6 and 7 and provided with internal partition wall portions 8, 9, 10 and 11. The box-like structure is thereby divided into an inner ventilating compartment 12, an outer ventilating compartment 13 and a chamber 14 for receiving a rolling louver assembly 15.

The inner ventilating compartment 12 communicates through a slit opening 16 with the living room 17 inside the main frame structure and with the outer ventilating compartment 13 through a flow passage 18 that may be closed by an adjustable damper flap 19.

As illustrated in FIG. 2, the outer ventilating compartment 13 includes air exhausts 20 and 21 located at both end walls 22 and 23 of the box-like structure and which in the mounted state of the window are included in the external sides of the complete main frame structure extending in vertical planes at the outer side of the roof.

The rolling louver assembly 15 rolled up in chamber 14 may travel up and down in associated guideways 24 provided for that purpose in the internal surfaces of the main frame members 2, and through a louver passage 25 on the outer side of the outer ventilating compartment 13 between the partition wall portion 11 and the external sidewall 4 of the box-like structure.

In the illustrated embodiment an exhaust fan 26 is provided in the inner ventilating compartment 12 and the box-like structure includes separate drive motors 27, 28 and 29 for the exhaust fan 26 and the rolling louver assembly 15 and for the control of damper flap 19 via an operating lever 19*a*. However, it is not absolutely necessary to provide the window with a built-in ventilator since the natural aeration through the box-like structure very often is sufficient. Likewise, the control of damper flap 19 does not necessarily need to be effected by a motor, but may, particularly in simple designs with natural aeration, be effected by simpler means, such as cord drives.

The embodiment illustrated in FIGS. 1 and 2 is particularly fitted for use as a stationary non-openable window in a large room assembly consisting of a considerable number of windows as illustrated by 30 to 35 in the example in FIG. 3.

In such an installation the activation of motors 27 to 29 in each window will advantageously be effected by remote control and the installation may then be designed so that a determined activation or control function may optionally be effected for one window or simultaneously for more windows.

The installation may for instance then be carried out by grouping the windows into three levels. On one level, only a single window is operated, e.g. 30 by means of an associated control unit 36. On a second level, an operational group comprises a number of windows selected from the total amount of windows, e.g. windows 33, 34 and 35 individually provided with control units 37, 38 and 39, respectively, by which said windows may be optionally operated individually or simultaneously from any of said control units 37, 38 and 39.

On the same level a second group may include a number of windows, e.g. 31 and 32, some of which have no associated control unit but are only operable from the control unit, e.g. 40 for one of the other windows in the group.

Finally, a control unit 41 which at the same time operates all windows of the installation may be provided for on a third operational level.

Instead of control units disposed in association with the individual windows in the installation every operation may be effected from a common control panel with the possibility of operating individual windows, simultaneous operation of a number of windows according to a grouping or simultaneous operation of all windows.

Control units in association with the individual windows may be carried out as schematically illustrated in the diagram in FIG. 4. The control unit in this figure includes a CPU 42 which over a communication gate 43 with address identification and a data bus 44 is in communication with the CPUs in the remaining control units.

The CPU 42 controls the supply of activating effect, e.g. 24 V DC for motors 27, 28 and 29, the current supply being effected by AC from the local current distributing system.

The operation is effected from an operation panel 45 which in the illustrated embodiment has selective contacts 46 and 47 for activation of motors 27 and 29 of the ventilator 26 and vent damper 19 together with three contacts 50, 51 and 52 for rolling down and up and stop of rolling louver assembly 15.

If it is desired to operate other windows from the actual control unit than the window associated with the unit, there is further provided a common button 53 with an associated light-emitting diode 54.

Eventually, the control unit may be connected to a thermostat 55 for automatically starting the ventilator motor 27 and activating the damper motor 29 to open flap 19 when the room temperature rises above a determined level.

We claim:

1. A roof window for installation in an inclined roof, wherein the roof window has a rectangular main frame structure having external surfaces on an external side of the roof, the main frame structure including at least an upper horizontal frame member at least partially designed as a hollow box-like structure having opposite end walls, and the frame member including a closeable passage for ventilating air between an internal side of the box-like structure and an external side thereof, characterized in that the box-like structure includes an inner ventilating compartment having an opening through which the inner ventilating compartment communicates with the internal side of the box-like structure, an outer ventilating compartment having air exhausts positioned at both end walls of the box-like structure, said end walls forming, in a mounted state of the roof window, part of the external surfaces of the main frame structure and extending in vertical planes from the external side of the roof, and a flow passage between the inner ventilating compartment and the outer ventilating compartment, the flow passage being provided with an adjustable damper.

2. A roof window as claimed in claim 1, characterized in that an exhaust fan (26) is arranged in the inner ventilating compartment (12).

3. A roof window as claimed in claim 2, characterized in that separate motors (27, 29) for said exhaust fan (26) and said damper (19) are provided within the box-like structure.

4. A room window as claimed in claim 1, characterized in that the box-like structure includes a separate chamber, a rolling louver assembly positioned in said separate chamber, the rolling louver assembly including a rolling louver, an independent drive motor in the separate chamber, the independent drive motor being connected to the rolling louver assembly, a louver passage, wherein said outer ventilating compartment has an outer side, and said louver passage is positioned on the outer side of the outer ventilating compartment, said main frame structure further including side members, and said room window further including guideways adjacent to said side members, said rolling louver being movable through said louver passage and in said guideways.

5. A room window as claimed in claim 3, characterized in that said motors (26, 28, 29) are remote-controlled.

6. A window installation for large rooms with inclined walls and comprising a number of roof windows (30 to 35) as claimed in claim 5, characterized in that the damper, exhaust fan and independent drive motors (27, 28, 29) for a number of windows may be selectively operated from a common control unit (36 to 41).

7. A window installation as claimed in claim 6, characterized in that at least one window is provided with a control unit for optionally, selectively effecting either local operation of the respective window or simultaneous operation of said window and a number of other windows of the installation.

8. A window assembly as claimed in claim 7, characterized in that said operating unit includes separate operation members (46, 47, 50 to 52) for damper, exhaust fan and independent drive motors (27, 28, 29) together with a common key (53) actuable to effect said simultaneous operation.

9. A room window as claimed in claim 1, characterized in that said opening is a slit.

10. A room window as claimed in claim 4, characterized in that the separate motors for the exhaust fan and the damper and the independent drive motor are remote-controlled.

* * * * *